US006478041B1

(12) United States Patent
Stede

(10) Patent No.: US 6,478,041 B1
(45) Date of Patent: Nov. 12, 2002

(54) FILLER VALVE FILLING FLAT POUCH CONTAINERS

(75) Inventor: Manfred Stede, Reichelsheim (DE)

(73) Assignee: Hassia Verpackungsmashinen GmbH, Ranstadt (DE)

( * ) Notice: Subject to any disclaimer, the term of this patent is extended or adjusted under 35 U.S.C. 154(b) by 0 days.

(21) Appl. No.: 09/744,540

(22) PCT Filed: May 25, 2000

(86) PCT No.: PCT/DE00/01723

§ 371 (c)(1),
(2), (4) Date: Jun. 25, 2001

(87) PCT Pub. No.: WO00/73151

PCT Pub. Date: Dec. 7, 2000

(30) Foreign Application Priority Data

Jun. 1, 1999 (DE) ..... 299 09 542

(51) Int. Cl.[7] ..... B08B 9/032; B65B 9/06

(52) U.S. Cl. ..... 137/240; 53/551; 53/553; 137/244; 134/166 C; 141/68; 141/69; 141/91

(58) Field of Search ..... 137/240, 242, 137/244; 53/551, 552, 553; 222/559, 630; 251/339; 141/10, 68, 69, 85, 89, 91; 134/166 R, 166 C

(56) References Cited

U.S. PATENT DOCUMENTS 4,363,429 A 12/1982 Schindler ..... 222/504
4,606,174 A * 8/1986 Berg ..... 53/551
4,608,810 A * 9/1986 Bordini ..... 53/551
4,769,974 A 9/1988 Davis ..... 53/451
5,822,958 A 10/1998 Davis ..... 53/551
6,260,336 B1 * 7/2001 Motomura ..... 53/551

FOREIGN PATENT DOCUMENTS

DE 299 09 542 9/1999

* cited by examiner

*Primary Examiner*—George L. Walton
(74) *Attorney, Agent, or Firm*—Collard & Roe, P.C.

(57) ABSTRACT

A fill valve assembly for filling a flat bag with an inhomogeneous fluid or viscous product, comprises a valve head of a cross-section dimensioned to fit into the flat bag and having a an outlet for the product and an extension of the outlet, the outlet and outlet extension extending along a central longitudinal axis of the valve head, and at least two product supply passageways extending in the valve head substantially parallel to the outlet and outlet extension, each product supply passageway having an end section terminating in the outlet at an angle of 25° to 45°. A purging space adjoins the outlet extension along the central longitudinal axis. The purging space has a somewhat larger diameter than the outlet extension, and at least a part of the purging space is located in the valve head. A plunger comprising a piston and a piston rod moves the piston up and down through the outlet extension into three positions, the outlet and outlet extension having at least twice the length of the piston. The piston in a lowermost first position closes the outlet and the end sections of the product supply passageways, in an intermediate second position is positioned in the outlet extension and opens the outlet and the end sections of the product supply passageways, and in an uppermost third position is positioned in the purging space for cleaning the piston.

9 Claims, 3 Drawing Sheets

FILLER VALVE FILLING FLAT POUCH CONTAINERS

CROSS REFERENCE TO RELATED APPLICATIONS

Applicants claim priority under 35 U.S.C. §119 of GERMAN Application No. 299 09 542.8 filed Jun. 1, 1999. Applicants also claim priority under 35 U.S.C. §120 of PCT/DE00/01723 filed on May 25, 2000. The international application under PCT article 21 (2) was not published in English.

BACKGROUND OF THE INVENTION

1. Field of the Invention

The present invention is concerned with a filler valve assembly to fill packing pouches or flat bags with inhomogeneous substantially liquid or pasty products.

2. Description of the State of Art

Filler valve assemblies of this type, basically, comprise a valve head including a central discharge outlet to be opened and closed by a plunger adjustable within the valve head and being in communication with the means for supplying the fill products.

A filler valve assembly of the afore-described type has been disclosed, for example, by U.S. Pat. No. 5,822,958, used to discharge the viscous products containing "particulate matter", i.e. small solid particles. The valve head is substantially formed of a hollow casing, the cavity of which, at the bottom end, passes over into a short discharge outlet in which a plunger reciprocates whose the plunger rod is guided within the cavity. The supply of the inherently inhomogeneous product to the discharge outlet takes place from the cavity to which the fill product is fed through a tube connected to the valve head, with the plunger rod also extending within the said tube. During dispensing, it is not safeguarded that each lot discharged into a bag has the same mixing ratio of the solid particles and the viscous component because, as stated previously, the fill product supply exclusively takes place through the cavity, i.e. in the event that a segregation has previously taken place in the fill product (always to be reckoned with) it is no longer safeguarded that each of the filled bags and each of the individual lot dispensed is of the same mixing ratio within the fill product. Moreover, the cross-sectional shape of the valve head according to U.S. Pat. No. 5,822,958 is relatively unfavourable for loading flat bags, as the cross-section thereof in flared condition substantially corresponds to a bi-angle.

OBJECTS AND SUMMARY OF THE INVENTION

It is an object of the invention to improve a fill valve assembly of the afore-described part to the effect that a substantially constant mixing ratio of at least two parts of the fill product be safeguarded in each lot of the fill product discharged by the valve into a bag.

Another object of the invention resides in better adapting the fill valve assembly and the valve head, respectively, to filling flat bags, and, finally, it is another object of the invention to enable easier purging of the fill valve assembly.

To achieve the afore-described objects, in the practice of the invention, a fill valve assembly is provided wherein, in combination, the valve head, in cross-section, is in the form of a flat rhombus or ellipse defined by a primary and by a substantially smaller secondary axis, and wherein the discharge outlet adjusted to the plunger diameter is extended into the valve head and is so dimensioned that it corresponds to at least twice the length of the plunger, with the extended portion of the said outlet accommodating the plunger in the open position thereof, and that provided on both sides of and in side by-side relationship with the extended discharge outlet, on the major axis of the rhombic cross-section, within the valve head, is at least respectively one product supply passage terminating in the bottom part of the discharge outlet.

As opposed to the fill valve assembly according to U.S. Pat. No. 5,82,958, showing a cavity from which the fill product simply flows off when the discharge outlet is in its open position, the plunger mounting and product supply spaces are separate, with the latter being in the form of at least two separate product supply passageways, thereby enabling the fill product components to be united separately and exactly metered directly ahead of the actual valve outlet, thus safeguarding that each of the dispensed lot is of the same mixing ratio. Moreover, the cross-sectional shape of the valve head adjusted, in the practice of the invention, to the flat bag shape, is used to directly accommodate the separate product supply passageways within the valve head.

To satisfy in valves of this type, the inevitable purging requirements (e.g. in product changes) and to comply with mandatory statutory sanitary provisions, in the practice of the invention, an advantageous development resides in that the upper end portion of the extended outlet passageway be of a diameter slightly larger than the plunger diameter and be provided with plunger guiding bridges. The said extended end portion is designed to serve as a detergent supply space provided with a detergent supply nozzle.

As described hereinafter in closer detail, it will also be possible for the detergent to be supplied through the plunger rod. It is true, a hollow plunger rod of this type along with a corresponding bore in the plunger, is also provided with the valve assembly according to the afore-quoted U.S. Pat. No. 5,822,958; however, in that citation, it serves to blow suitable gases therethrough to help to clear the outlet opening of the cavity in case it should have become stuck.

BRIEF DESCRIPTION OF THE DRAWINGS

The present invention together with further objects and advantages may best be understood by reference to the following description, taken in connection with the accompanying drawings, in which.

DESCRIPTION OF PREFERRED FORMS OF EMBODIMENT

Figure 5:
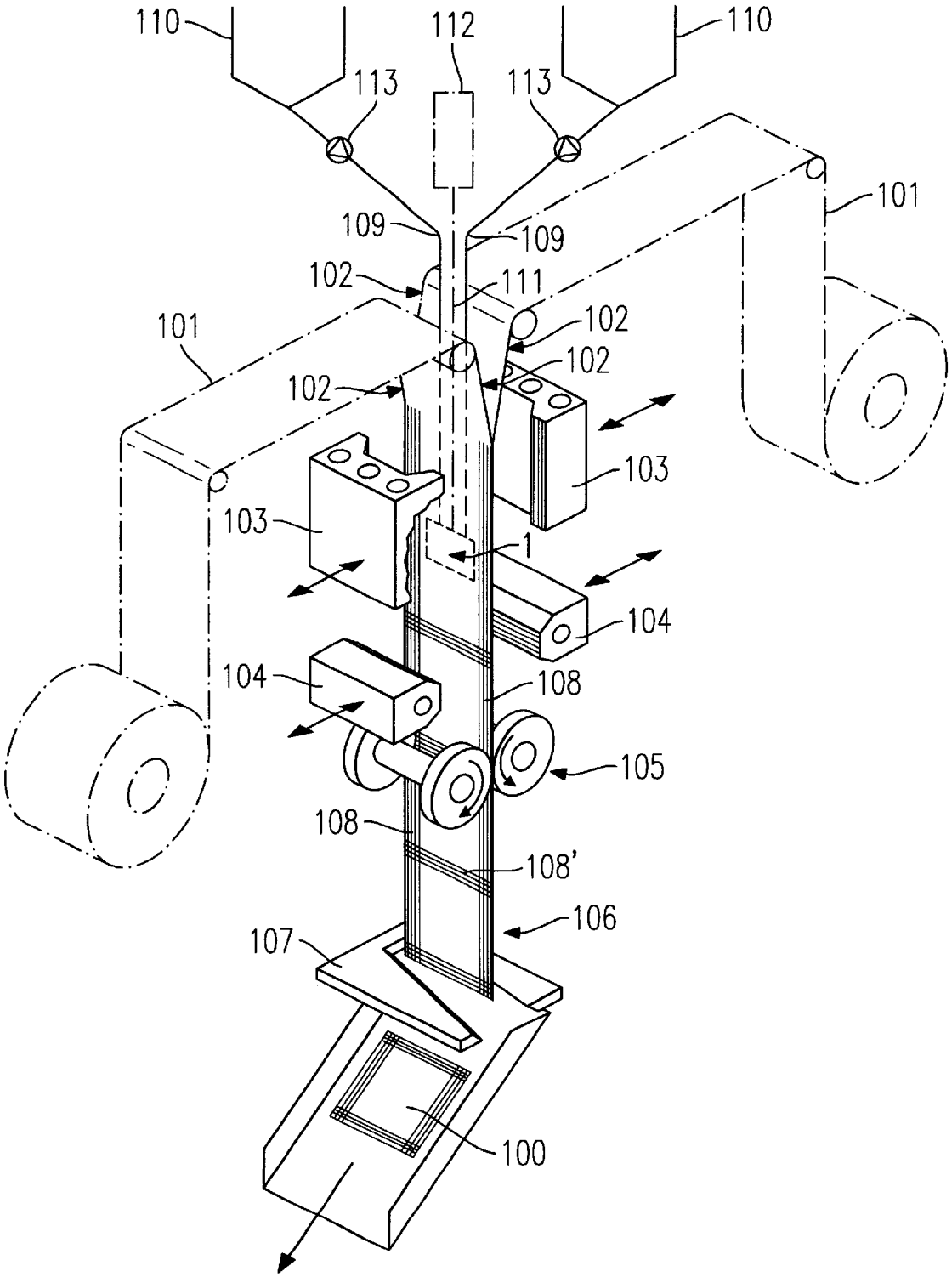
FIG. 5 schematically shows the principle of operation of a bagging machine.

Now, reference is had to the manufacture and loading of so-called pouch containers (flat bags) by a bagging machine furnished with the fill valve assembly of the invention. A machine of that type is schematically shown in FIG. 5 wherein the fill valve is also shown in broken lines. The flat bags 100 to be manufactured and filled through a fill valve assembly are formed of two foil webs 101 between which is provided the valve head 1 of the filler valve assembly yet to be explained in greater detail hereinafter. The edges 102 of the two foil webs 101, in known per se manner, are connected by longitudinal sealing tools 103; transverse sealing is effected by transverse sealing yaws 104, whereas discharge rollers 105 insure the cyclical discharge of the packing material web from which the finally loaded flat bags 100 will be cut off by means of a cutter 107. The valve head 1 is held by rigid product supply conduits 109 that proceed from reservoirs 110. If so required by the viscosity of the fill product, correspondingly controlled feed pumps 113 may be provided in the product supply conduits 109. The dash-dotted line 111 schematically shows the plunger rod for the plunger 2 of the valve head 1. The actuator for the plunger rod equally shown schematically only, is designated by numeral 112.

The fill valve assembly of the invention for a bagging machine of the afore-described type comprises a valve head 1 adapted in cross-section to the bag opening cross-section, including a central discharge outlet 3 to be opened and closed by a plunger 2 adjustable within the valve head 1, and being in communication with the fill product supplying means. Based on the illustration according to FIG. 1, the said discharge outlet 3 the diameter of which corresponds to the one of the plunger, for the presently contemplated purposes, is extended into the valve head 1. The said extended portion 3' accommodates the piston 2 in the open position II; in addition to the said extended discharge outlet 3, at least two separate product supply passageways 4 terminating in the bottom part of the discharge outlet 3 are provided in the valve head 1.

Figure 1:
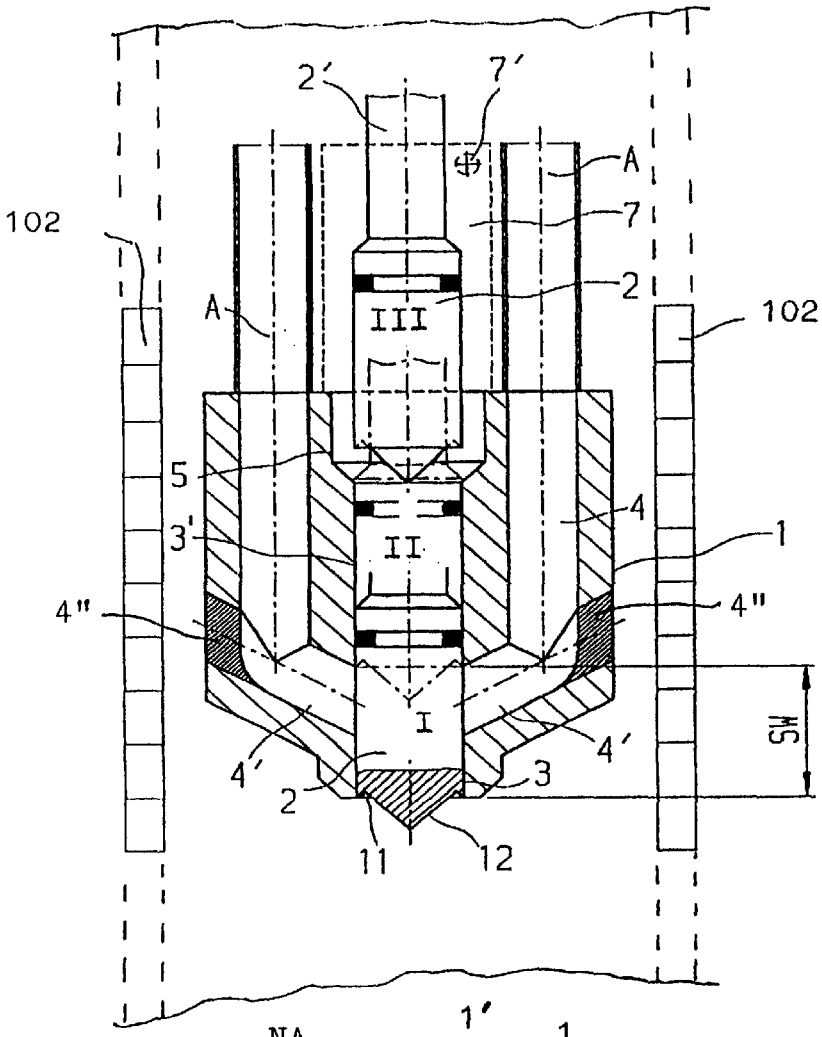
FIG. 1 shows a longitudinal section through a fill valve assembly.

In FIG. 1, the adjusting or opening and closing paths of the plunger 2 are designated by SW; moreover, the plunger 2 is shown in three different positions, namely, in the closing position I, in the opening position II and the purging position III.

Figure 2:
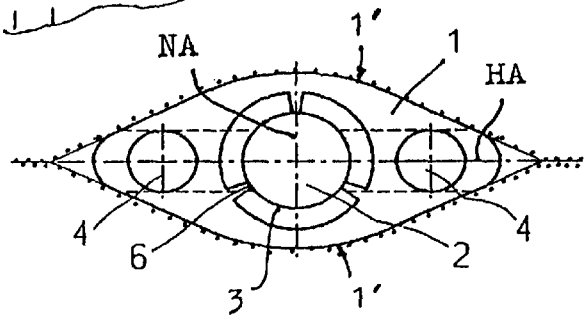
FIG. 2 is a plan view of the fill valve assembly according to FIG. 1.
Figure 2A:
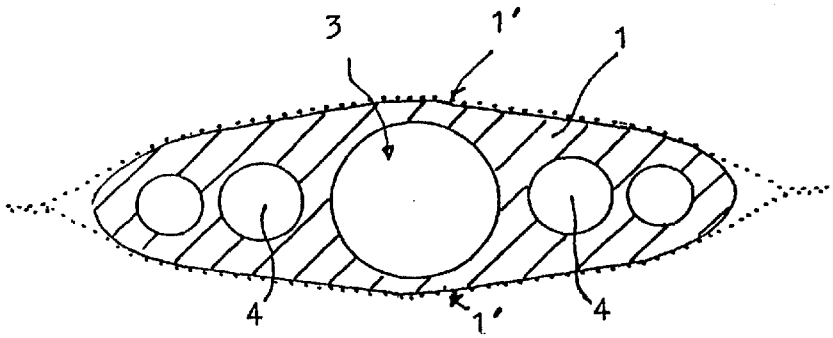
FIG. 2A is a plan view of a filler valve assembly with an extended major axis.

Moreover, the cross-sectional shape of the valve head 1 is important in view of the fact and in reference to FIGS. 2 and 2A, that the secondary axis NA of the valve head 1 corresponds to between half and a quarter of the length of the mayor axis HA, and that the side flanks 1' of the valve head 1 are arcuate and the valve head 1, at the ends of the major axis HA thereof, is of a rounded configuration.

Hence, the valve head 1 is optimally adapted to the cross-sectional shape of the flat bag; in this respect, it will have to be taken into consideration that the valve head 1 at the same time, is a shaping element for the two webs of packing material 101 during inflow thereof, thus creating no problems in respect of sealing the longitudinal edges 108 of the flat bags. The two webs of packing material 101 forming the respective flat bag and enclosing the valve head 1 are shown in dotted lines in FIGS. 2 and 2A. Let us assume that in the two product supply passageways 4, for example, vinegar, on the one side, and an oil-spice mixture, on the other side, are available in correspondingly metered amounts. Once plunger 2 moves to the opening position II, the said components flow into the discharge outlet 3 or are dispensed, under pressure, by means of the aforementioned feed pumps 13, into the flat bag 100 shown in FIGS. 1 through 4 by the longitudinal edges 102 only, in which the valve head 1, during the filling operation, is immersed adequately deeply, with the bag, after loading, being sealed by the transverse sealing weld 108' to be subsequently applied.

If the dimensions of the bag 100 so permit and if it is required to mix, for example, three or four fill product components, it would be readily possible to provide one or two additional product supply passageways 4 within the valve head 1 as shown in FIG. 2A.

To achieve small dimensions of the valve head 1 in the manufacture of bags 100, the lower end sections 4' of the two product supply passageways as shown in FIGS. 1 through 4 are arranged to converge, in the outlet direction, at an angle of between 25° and 45°, terminating in the outlet 3. The said converging end sections 4' are generated by simply boring the valve head 1 to be subsequently sealed by appropriate means 4".

For purging purposes, the valve head 1 is so designed that the upper end section 5 of the extended outlet 3 is of a slightly larger diameter than the plunger and is provided with guiding bridges 6, while the expanded or flared end section 5 is designed in the form of a detergent supply space 7 provided with a detergent supply nozzle 7'. The said supply space 7 in FIG. 1 is only shown as a dashed line, covering the expanded end section 5 within the valve head 1. As shown, plunger 2, in the purging position III in detergent supply space 7 is circumferentially cleared, thereby permitting circumferential purging thereof. If purging is required, plunger 2 is moved into the purging position III, opening the detergent supply nozzle 7'. Switch-over valves on nozzles A, A of the product supply passageways 4 (not shown) are provided to insure cleaning thereof if so required.

Figure 3:
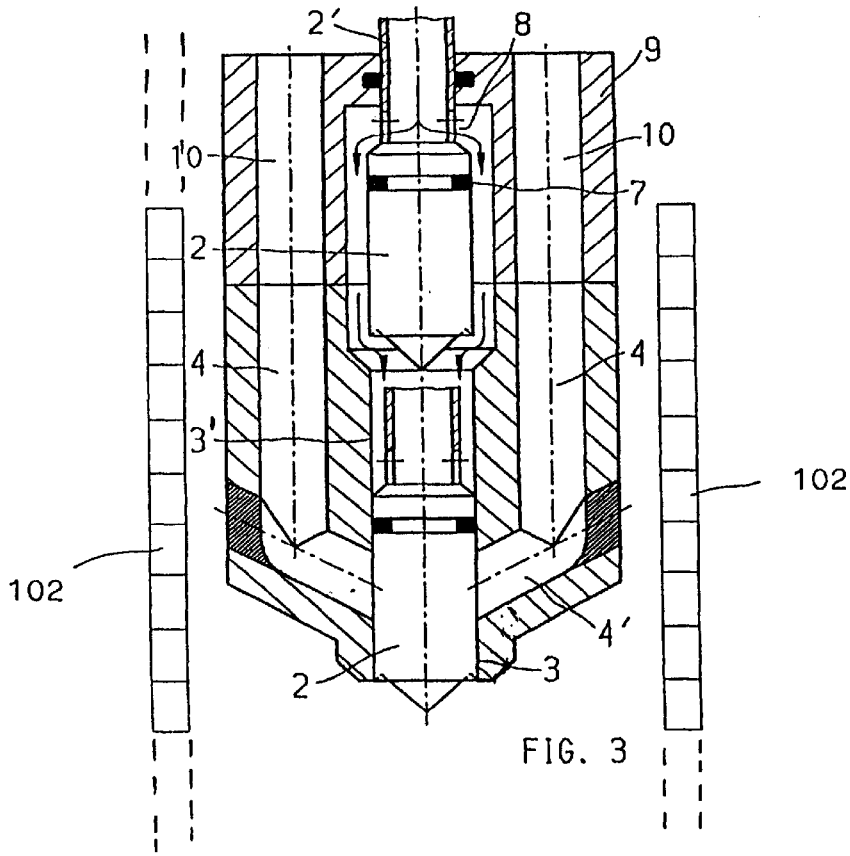
FIG. 3 shows a longitudinal section according to FIG. 1 in a slightly modified form of embodiment.

For purging purposes, the form of embodiment shown in FIG. 3 is the preferred one, wherein, as previously described, the upper end section of the extended discharge outlet 3 is of a slightly larger diameter than the plunger and is provided with guiding bridges 6 and, sealed against rod 2' of plunger 2 to form the detergent supply space, is externally closed; however, in that case, the plunger rod 2' is of a hollow configuration and, immediately above the plunger 2, is provided with detergent discharge ports 8.

Figure 4:
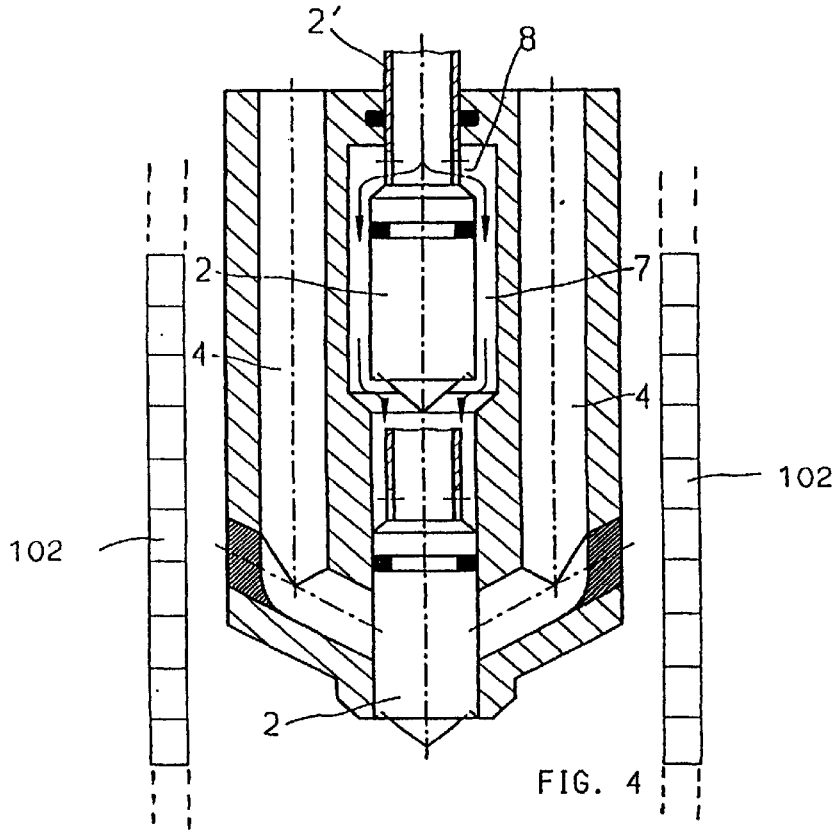
FIG. 4 shows a longitudinal section of another form of embodiment.

The upper section of the detergent supply space 7 can, as shown in FIG. 3, be in the form of a casing 9 sealingly mounted on the valve head 1. However, it is also possible, as shown in FIG. 4, to house the entire detergent supply space 7 within the correspondingly larger dimensioned valve head 1. The illustration of corresponding structural details has been foregone in FIG. 4.

In the event that the upper section of the detergent supply space 7 is mounted as a separate casing 9 it is feasible to provide therein passage tongues 10 bored therein and extending in registry with the product supply passageways 4 within the valve head 4.

According to the sectional view of the partial area of plunger 2 as shown in FIG. 1, the same is preferably provided, on the bottom end thereof having a flow leading tip 12, with a circumferential and projecting, i.e. undercut, knife-type cutting edge 11 serving for sharply cutting off coarse matter contained in the fill product.

What is claimed is:

1. A fill valve assembly for filling a flat bag with an inhomogeneous fluid or viscous product, which comprises (a) a valve head of a cross-section dimensioned to fit into the flat bag and having a primary and a secondary axis, the primary axis being substantially longer than the secondary axis, the valve head having (1) an outlet for the product and an extension of the outlet, the outlet and outlet extension extending along a central longitudinal axis of the valve head, and (2) at least two product supply passageways extending in the valve head substantially parallel to the outlet and outlet extension, each product supply passageway having an end section terminating in the outlet at an angle of 25° to 45°, (b) a purging space adjoining the outlet extension along the central longitudinal axis and having a somewhat larger diameter than the outlet extension, at least a part of the purging space being located in the valve head, and (c) a plunger comprising a piston and a piston rod for moving the piston up and down through the outlet extension into three positions, the outlet and outlet extension having at least twice the length of the piston, (1) the piston in a lowermost first position closing the outlet and the end sections of the product supply passageways, (2) the piston in an intermediate second position being positioned in the outlet extension and opening the outlet and the end sections of the product supply passageways, and (3) the piston in an uppermost third position being positioned in the purging space for cleaning the piston.

2. The fill valve assembly of claim 1, wherein the primary axis has a length between twice to four times the length of the secondary axis.

3. The fill valve assembly of claim 1, wherein the ends of the cross-section of the valve head along the primary axis are rounded.

4. The fill valve assembly of claim 1, further comprising a cleaning fluid supply nozzle in the purging space for supplying a cleaning fluid thereto.

5. The fill valve assembly of claim 1, further comprising guiding bridges projecting radially into the purging space for guiding the piston rod.

6. The fill valve assembly of claim 1, further comprising an end wall closing the purging space, the piston rod extending fluid-tightly through the end wall, being hollow, and having a discharge port for discharging a cleaning fluid through the hollow piston rod into the purging space.

7. The fill valve assembly of claim 6, wherein an upper section of the purging space and the end wall are in a casing sealingly mounted on the valve head, and the casing defines bores aligned with the product supply passageways of the valve head.

8. The fill valve assembly of claim 1, wherein an end section of the plunger piston has a circumferentially extending, undercut cutting edge.

9. The fill valve assembly of claim 1, wherein an end section of the plunger piston has a flow-guiding tip.

* * * * *